United States Patent [19]

Edlin et al.

[11] Patent Number: 4,594,532

[45] Date of Patent: Jun. 10, 1986

[54] MULTIMEGAVOLT HIGH CURRENT SWITCH

[75] Inventors: George R. Edlin, Huntsville, Ala.; John D. Robb, St. Paul, Minn.

[73] Assignee: The United States of America as represented by the Secretary of the Army, Washington, D.C.

[21] Appl. No.: 621,273

[22] Filed: Jun. 15, 1984

[51] Int. Cl.[4] ..... H01J 1/46; H01J 7/30

[52] U.S. Cl. ..... 315/331; 315/332; 313/152; 313/146

[58] Field of Search ..... 315/331, 332; 313/146, 313/152

[56] References Cited

U.S. PATENT DOCUMENTS

| | | | |
|---|---|---|---|
| 2,257,768 | 10/1941 | Spencer | 313/152 X |
| 2,607,024 | 8/1952 | Marwell et al. | 313/152 X |
| 3,515,926 | 6/1970 | Rich | 313/146 |
| 3,588,572 | 6/1971 | Beese | 313/152 X |
| 3,893,045 | 7/1975 | Jacobson et al. | 331/94.5 G |
| 3,940,710 | 2/1976 | Lemay | 331/94.5 PE |
| 4,068,192 | 1/1978 | Hintz et al. | 331/94.5 G |

FOREIGN PATENT DOCUMENTS

| | | | |
|---|---|---|---|
| 962306 | 7/1964 | United Kingdom | 313/152 |

*Primary Examiner*—David K. Moore
*Assistant Examiner*—Vincent DeLuca
*Attorney, Agent, or Firm*—Anthony T. Lane; Robert P. Gibson; Freddie M. Bush

[57] ABSTRACT

A low cost multimegavolt high current switch that can effectively switch voltages in the megavolts range and currents in the order of 200 thousand amperes. Switching is accomplished by the movement of a conductive member from a first electrically isolated position to a second electrically isolated position. During movement along a guided path the conductive member passes through an arc gap, initiating an arc or plasma in the gap to accomplish the switching action. Movement of the conductive member from one position to the other may be accomplished by gravity, pressure, electromotive drive, or other propelling means.

6 Claims, 2 Drawing Figures

MULTIMEGAVOLT HIGH CURRENT SWITCH

DEDICATORY CLAUSE

The invention described herein may be manufactured, used, and licensed by or for the Government for governmental purposes without the payment to us of any royalties thereon.

BACKGROUND OF THE INVENTION

Electrostatic discharge and lightning testing of numerous components, equipment, and systems is consistantly being done to assure both the safety of people in the presence of such components and systems as well as the reliability thereof. The requirement for electrostatic discharge and lightning testing of various military and civilian systems often makes it necessary to efficiently switch currents on the order of 200,000 amperes and voltages from 50,000 volts to multimegavolts. The types of items involved at these higher currents and voltages are usually explosives or electronics; however, in some cases physical damage to structures and housings is of major concern. Currently there are no low cost simple switches commercially available to accomplish the task of switching voltages and currents used in electrostatic discharge and lightning testing. This type of testing is also increasing in importance due to the large number of systems employing complex electronic circuits and the use of new and exotic semiconductive materials in the construction of strong light weight enclosures.

SUMMARY OF THE INVENTION

The low cost multimegavolt high current switch is a transient switching arc initiator that can effectively switch voltages in the megavolts range and currents in the order of 200,000 amperes. Switching action takes place in the system when a conductive member having no external electrical connection thereto is passed momentarily through a desired path of current discharge. When the conductive member passes through the gap of the desired current path, the gap space separating two terminals is instantaneously and momentarily closed or greatly reduced, allowing a high voltage current path to be established therebetween. As the conductive member moves through the gap an arc is established due to high voltage already developed between the terminals. The transient conductive member moves on out of the current path. The arc is extinguished when the voltage developed across the terminals decays to a level that can no longer sustain an arc across the gap. The system provides smooth arc initiation with minimum damage to the switching member since the switching member does not remain in the path of current.

DESCRIPTION OF THE PREFERRED EMBODIMENT

Figure 1:
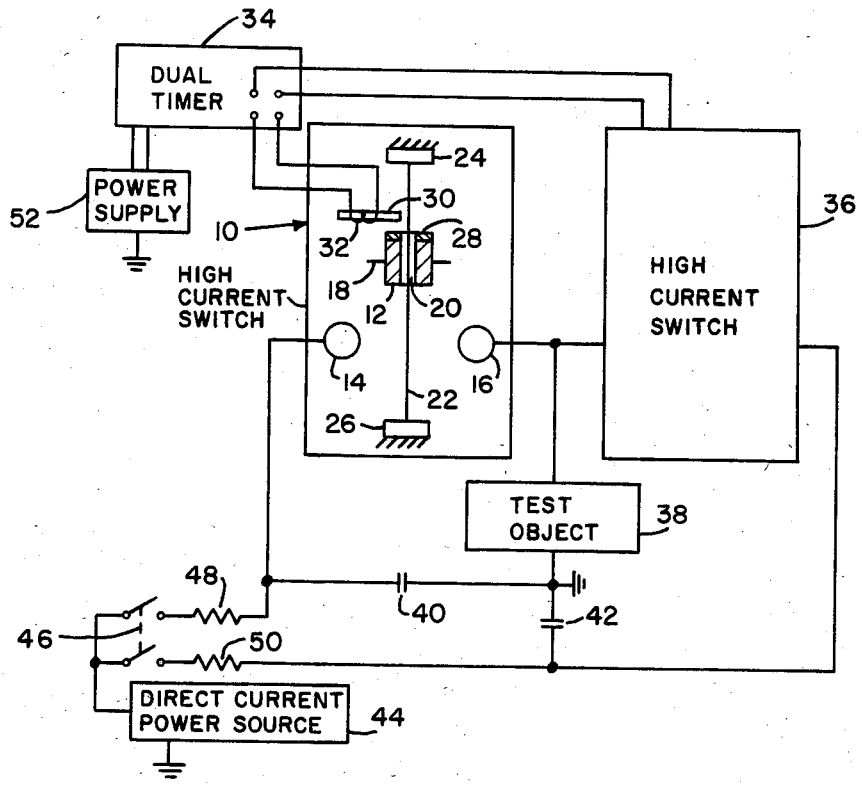
FIG. 1 is a schematic diagram of a preferred embodiment of a gravity operated multimegavolt high current switch system.

Referring now to the drawings wherein like numbers refer to like parts, FIG. 1 discloses a schematic diagram of a multimegavolt high current switching system which provides transient switching for arc initiation. In the embodiment of FIG. 1, switch 10 is disposed to provide transient conductor motion for initiating an arc or plasma by using the force of gravity to drive a conductive switching member 12 between two conductive terminals 14 and 16 for initiating a high voltage current arc therebetween. Conductive member 12 is a brass weight having small gauge copper wires 18 projecting from either side thereof in the direction of terminals 14 and 16. Copper wires 18 function as plasma initiators as weight 12 and wires 18 pass between terminals 14 and 16. Typically brass weight 12 may be cylindrical or conical in shape with a cylindrical opening 20 passing through the length thereof. A simple non-metallic, non-conducting guide 22 is passed through opening 20 and fixed to support members 24 and 26 for providing a substantially longitudinal or straight line free-fall path for weight 12 between terminals 14 and 16. Non-metallic guide 22 may be a simple heavy duty string, around which brass weight 12 could freely rotate without binding the string. Although weight 12 could rotate, it is not likely to occur. However, to assure alignment, copper wires 18 may be uniformly disposed around the circumference of brass weight 12 in a plane much as the spokes of a wheel would be. To avoid the possible need for a large number of wires 18, guide 22 may be readily keyed to a similar shaped opening 20 in brass weight 12, such as a T-slot, to thereby maintain brass weight 12 in a relatively fixed position of non-rotation on the guide and thereby eliminate the need for extra copper wire initiators. To operate switch 10, brass weight 12 is releasably held in the vicinity of support member 24 and released at a desired time for initiation of an arc. Gravity pulls the brass weight toward support member 26 along guide 22 and between terminals 14 and 16. The reduction of the air gap between terminals 14 and 16 as the brass weight and copper wires pass therethough results in an intense electric field between the terminals, causing the gap to be bridged by the resulting plasma when a high voltage field has been developed across the terminals prior to release of the weight. Once initiated, the arc is sustained by the voltage across the terminals after the weight passes on through.

A simple way of holding brass weight 12 in the elevated position is by attaching a soft iron plate 28 to the upper surface of weight 12 and placing the soft iron plate adjacent the magnetic iron core 30 of a solenoid 32. When the solenoid is activated, the iron core 30 moves away from plate 28 and weight 12 allowing the weight to fall.

In the gravitational system of FIG. 1 the solenoid 32 of switch 10 is controlled by a dual timer circuit 34 which also drives or controls another gravitational switch 36 identical to switch 10. A test object 38 is disposed to receive a high voltage surge to simulate sudden electrostatic discharge or lightning surges. A first capacitor bank 40 is connected on one side to ground and the test object and on the other side to terminal 14 of switch 10. The other high voltage terminal, 16, is connected to the test object for selectively developing a high voltage-current surge across the test object upon initiation of a plasma between terminals 14 and 16 and discharge of capacitor bank 40 therethrough. Similarly, a capacitor bank 42 is also connected on one side to system ground and the test object and on the other to a terminal of switch 36. The other high voltage terminal of switch 36 may be connected in conjunction with switch terminal 16 to the test object or at a different location on the test object. Typically, a power supply 44 is coupled through an isolation switch 46 and isolation resistors 48 and 50 to respective capacitor banks 40 and 42 for charging the capacitor banks. Once the capacitor banks are charged switch 46 is opened. Dual timer 34 may be driven by a power supply 52 for providing the timing voltage thereto and to the solenoids. The two high current, high voltage switches 10 and 36 may be sequenced by the timer to provide desired sequencing of current injections into the test object. This method of sequencing allows any number of high current, high voltage generators to be synchronized with respect to their times of activation or initiation. The basic switches 10 and 36 have the non-conductive guide 22 positioned vertically so that the brass weight slides freely on the guide. High voltage terminals 14 and 16 may be stainless steel balls positioned a sufficient distance apart to hold off or prevent arbitrary discharge of the generator voltage (capacitor banks 40 and 42 providing the generator voltage) across the gap prior to momentary insertion of the brass cylinder in the gap. The high voltage terminals 14 and 16 may be movably disposed and spaced apart to provide an adjustable arc gap therebetween, allowing flexibility in the use of the system and in the range of voltages and currents that may be switched by a single device.

In a typical operating sequence capacitors 40 and 42 are charged via direct current power source 44, after which switch 46 is opened and dual timer 34 is activated to initiate timing. At a time $t_1$ voltage from power supply 52 is coupled through timer 34 to activate solenoid 32. The solenoid releases weight 12, which accelerates downward on the non-metallic guide due to the gravitational force of the weight. The weight 12 with plasma initators 18 thereon passes through the gap between stainless steel balls 14 and 16. The reduction of the distance between balls 14 and 16 results in an intense electric field between the balls and subsequently the gap is bridged by the resulting plasma. The charge on capacitor bank 40 is then dumped into the test object. Depending on the timing set in dual timer 34, high current switch 36 is activated in the same manner as switch 10 to allow the dumping of capacitor bank 42 into the test object. The capacitor banks voltages are discharged across the gap between the stainless steel ball terminals until the voltage from the respective capacitor banks can no longer sustain the plasma or arc discharge, at which time current flow is extinguished and the system is ready to be reset. The switch is reset simply by manually returning the brass weight to the upper stop position and engaging the weight retention mechanism.

Figure 2:
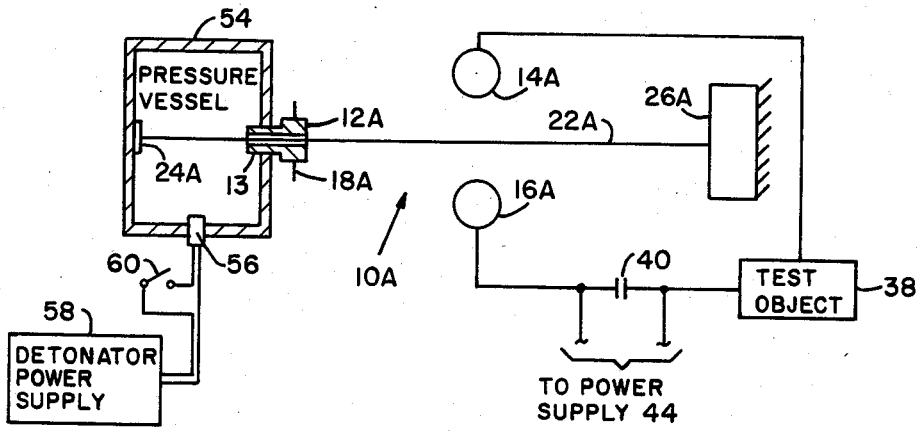
FIG. 2 is a schematic of an electroexplosively operated multimegavolt high current switch.

FIG. 2 discloses an electroexplosively operated multimegavolt high current switch shown in schematic form wherein operation of the switch is non-gravitational operation. As with switch 10, switch 10A comprises a brass cylinder or cone 12A, which may itself function as the plasma initiator alone or have wires 18A selectively embedded in the circumference thereof for initiating plasma flow. Brass conductive member 12A is movably disposed on a non-conductive guide 22A which is substantially rigid or taut between support members 24A and 26A. Stainless steel balls 14A and 16A are disposed for establishing an arc or plasma substantially normal to the path established by guide 22A as brass conductor member 12A passes therebetween. Again test object 38 and capacitor bank 40 are connected in series with terminals 14A and 16A for developing a high voltage discharge across the test object. Capacitor bank 40 is disposed to be charged by power supply 44. The activating mechanism for switch 10A comprises a pressure vessel 54 within which support member 24A is mounted and non-metalic guide 22A passes through an opening in the vessel to be anchored to support member 24A. Brass conducting member 12A has a reduced outer cylindrical portion or keyed portion thereof 13 projecting through an opening in pressure vessel 54 for releasably or movably sealing the opening. An electroexplosive device 56 projects into pressure vessel 54 and is electrically connected to a detonator power supply 58 by way of a switch 60. At the desired time of testing a remotely located operator may depress switch 60, supplying power to the electroexplosive device 56 which generates pressure within pressure vessel 54 propelling conductive members 12A and 18A along guide 22A between the stainless steel balls to stop 26A. A plasma arc is initiated as the conductive member 12A passes between stainless steel balls 14A and 16A, supplying a high voltage-high current surge to test object 38.

Various methods may be used to propel initiator or conductive member 12 or 12A along the guide. Typical of these is the use of compressed air or electromagnetic force. Obviously a large number of high current, high voltage generators can be synchronized to sequentially or simultaneously initiate arc discharges between the high voltage source terminals across a test object.

Although the present invention has been described with reference to a simple preferred embodiment, workers knowledgable in the art will recognize that changes may be made in the form and detail of various aspects of the invention without departing from the spirit and scope of the foregoing disclosure. Accordingly the scope of the invention should be limited only by the claims appended hereto.

We claim:

1. A transient switch for initiating high voltage current flow comprising: first and second electrically conductive terminals disposed for having voltage developed thereon, said terminals being positioned a distance apart to prevent arbitrary initiation of current flow therebetween; a conductive member disposed for transient passage directly between said terminals and electrically isolated from external electrical connection; and nonconductive guide means for directing said conductive member through the plane of said terminals along a substantially normal path between the terminals; said conductive member being a cylindrical brass weight having a hole through the center of the cylinder and being movably attached to said guide, and said nonconductive guide being positioned through said hole in the weight.

2. A transient switch as set forth in claim 1 wherein said guide is a taut string.

3. A transient switch as set forth in claim 1 wherein said nonconductive guide has a guide length along an axis normal to and passing through the plane of said terminals; and further comprising retaining means adjacent the first end of the guide length for releasably retaining said brass weight on one side of the terminal plane prior to operation of said switch; and stopping means adjacent the second end of the guide length for stopping the brass weight on the other side of the plane of the terminals after operation of the switch.

4. A transient switch as set forth in claim 3 wherein said guide length lies along a vertical axis and the first end of the guide length is the upper end of the length.

5. A high voltage switching circuit for initiating high current arcs comprising: at least first and second electrical conductive terminals movably disposed and spaced apart to provide an adjustable arc gap therebetween, a high voltage source of direct current coupled to said terminals for developing a high voltage thereacross, a conductive member, and elongated, nonconductive guide means having a guide length thereof disposed along an axis passing through the arc gap in the plane of said terminals, and said conductive member being movably disposed on said guide means for passage back and forth between said terminals from a first end of the guide length to a second end of the length.

6. A high voltage switching circuit for initiating high current arcs as set forth in claim 5 and further comprising control means for releasably retaining said movable conductive member adjacent the first end of the guide length prior to operation of the switching circuit.

* * * * *